United States Patent [19]

Suzuki et al.

[11] 4,439,137

[45] Mar. 27, 1984

[54] METHOD AND APPARATUS FOR COMBUSTION WITH A MINIMUM OF NOX EMISSION

[75] Inventors: Tomio Suzuki; Kotaro Morimoto, both of Kobe, Japan

[73] Assignee: Kobe Steel, Limited, Kobe, Japan

[21] Appl. No.: 425,701

[22] Filed: Sep. 28, 1982

Related U.S. Application Data

[63] Continuation of Ser. No. 106,001, Dec. 21, 1979, abandoned.

[30] Foreign Application Priority Data

Dec. 21, 1978 [JP] Japan ..... 53-159054
Apr. 23, 1979 [JP] Japan ..... 54-050728

[51] Int. Cl.[3] ..... F23M 3/04

[52] U.S. Cl. ..... 431/8; 431/10; 431/181; 431/190; 431/187

[58] Field of Search ..... 431/8, 10, 181, 187, 431/188, 190, 351; 239/558

[56] References Cited

U.S. PATENT DOCUMENTS 1,953,275 4/1934 Straitz .
2,140,088 12/1938 MacDonald .
2,458,543 1/1949 Urquhart .
2,834,407 5/1958 Mason .
3,771,944 11/1973 Hovis et al. .
3,957,420 5/1976 Asai .
4,021,186 5/1977 Tenner .
4,162,890 7/1979 Hirose .
4,357,134 11/1982 Katsushige et al. ..... 431/181

FOREIGN PATENT DOCUMENTS 314614 7/1929 United Kingdom .
393723 7/1933 United Kingdom .

*Primary Examiner*—Carroll B. Dority, Jr.
*Attorney, Agent, or Firm*—Oblon, Fisher, Spivak, McClelland & Maier

[57] ABSTRACT

A method an apparatus for combustion with a minimum of NOx emission in various industrial furnaces and boilers. By injecting air for combustion into a furnace through the burner tile or air baffle in the deviated flow pattern asymmetrical with respect to the burner tile or baffle axis, the quick mixing of the air and fuel in early stages of combustion is suppressed to provide for a relatively gentle combustion and allow the burnt gas self-circulation to take place effectively, thereby minimizing the emission of nitrogen oxides.

7 Claims, 26 Drawing Figures

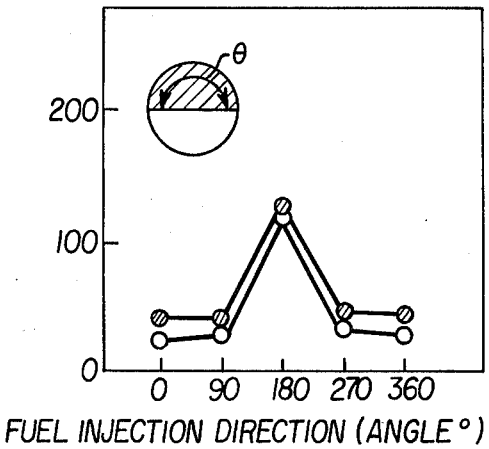
FIG. 14 (I)
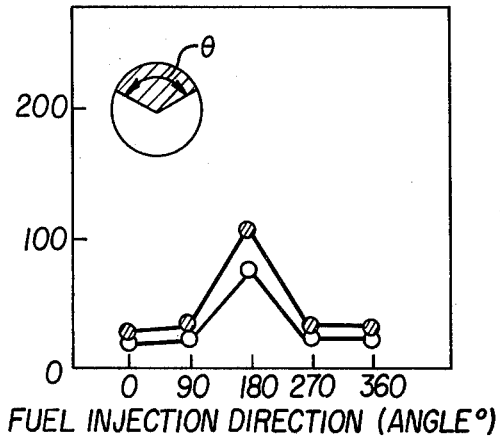
FIG. 14 (II)
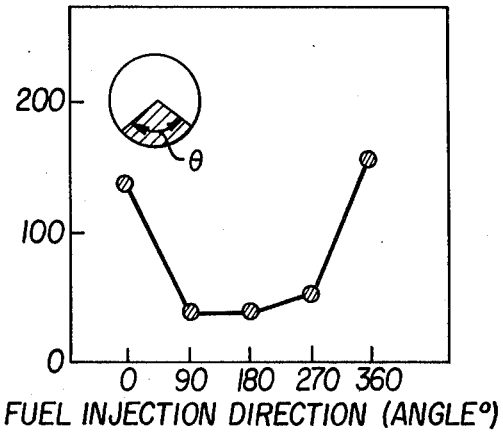
FIG. 14 (III)

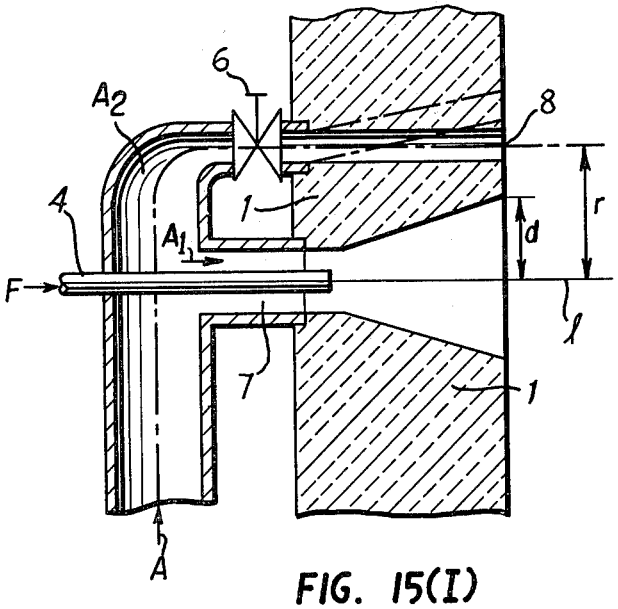
FIG. 15(I)
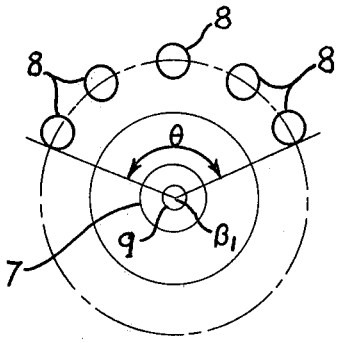
FIG. 15(II)
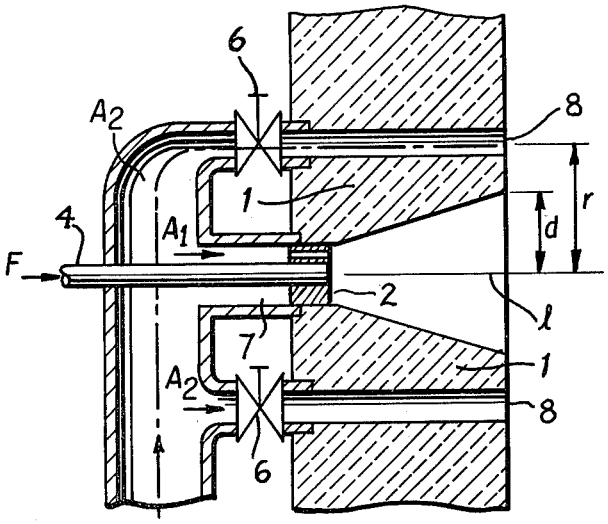
FIG. 16(I)
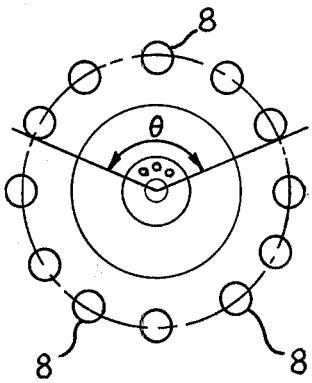
FIG. 16 (II)

METHOD AND APPARATUS FOR COMBUSTION WITH A MINIMUM OF NOX EMISSION

This is a continuation of application Ser. No. 106,001, filed Dec. 21, 1979, now abandoned.

BACKGROUND OF THE INVENTION

1. Field of the Invention

The amount of nitrogen oxides (hereinafter referred to as NOx) which forms as gaseous or liquid fuels burn in various industrial furnaces or boilers depends on conditions for combustion, especially such factors as the flame temperature, oxygen concentration and residence time of the burnt gases in the high temperature region; the higher the flame temperature and the higher the oxygen concentration, the larger the amount of NOx.

2. Description of the Prior Art

It has been a common practice for combustion in general to ensure the uniform mixing of combustion air and fuel as early as possible to effect quick combustion, from the standpoint of increasing combustion efficiency. Such quick combustion, however, elevates the flame temperature, enlarges the high temperature region in the furnace and increases the localized oxygen concentration in the combustion zone, with the consequent result of the formation of a large amount of NOx. Hence an incompatibility between desires for maximum combustion efficiency and a minimum of environmental pollution.

SUMMARY OF THE INVENTION

With these circumstances in mind, we have conducted intensive research to develop a rational methods for suppressing the quick mixing of fuel and air to ensure a slow or gentle combustion in order to minimize NOx emission. As a result, we have found that by causing the air for combustion injected into the furnace to take a deviated or deflected flow pattern asymmetrical with respect to the axis of the air baffle or burner tile and by restricting the deviation of air flow in a fixed range, it is possible to provide for a unique combustion effectively minimizing the formation of NOx while increasing combustion efficiency, advantageous also from the standpoint of energy saving.

A first phase of the invention provides a novel method of combustion with a minimum of NOx emission using gaseous or liquid fules in various industrial furnaces or boilers, characterized in that the sectorial or straddle angle of an injection opening section for air for combustion which is to be fed into a furnace through a burner tile or air baffle is less than 240° with the center at the burner tile or air baffle axis, whereby the air for combustion is injected into the burner to take a deviated flow pattern asymmetrical with respect to the burner tile or air baffle axis.

A second phase of the invention provides a method of combustion as set forth in said first phase, characterized in that a fuel is deviation-injected by using a fuel injection burner whose fuel injection port is inclined at an angle of 5°–45° with respect to said burner axis (such burner being hereinafter referred to as the "inclined type burner").

A third phase of the invention provides a method of combustion as set forth in the first or second phase, characterized in that the fuel flow rate/combustion air flow rate ratio is controlled so that it is more than 0.3.

A fourth phase of the invention provides a method of combustion as set forth in any of said first through third phases, characterized in that the burner tip position is determined so that the ratio (L/D) of the inner furnace end surface bore diameter (D) of the burner tile to the distance (L) between the inner furnace end surface and the burner tip is less than 1.3 for the inclined type burner and less than 0.8 for the normal type burner.

A fifth phase of the invention provides a method of combustion as set forth in any of the first through fourth phases, characterized in that the deviated direction of flow of the air is determined depending upon the relative positional relation between the burner and the material to be heated so that the combustion air flow may not impinge directly against the material.

A sixth phase of the invention provides a method of combustion as set forth in any of the first through fifth phases, characterized in that the fuel is deviation-injected toward the side located opposite the center of gravity of the combustion air flow.

A seventh phase of the invention provides a two-stage combustion apparatus for use with various industrial furnaces or boilers, characterized in that disposed outside a burner tile provided with a burner and the first-stage combustion air feed passage surrounding the burner are the second-stage combustion air feed passages and the straddle angle of the inner furnace air injection opening section of the second stage combustion air feed passages is less than 240° with the center at the axis of the burner tile.

An eighth phase of the invention provides a two-stage combustion apparatus for use with various industrial furnaces or boilers, characterized in that disposed outside a burner tile provided with a burner and the first-stage combustion air feed passage surrounding the burner are the second-stage combustion air feed passages and the straddle angle of the inner furnace air injection opening section of each of the first and second stage combustion air feed passages is less than 240° with the center at the axis of the burner tile.

A ninth phase of the invention provides an apparatus for combustion with a minimum of NOx emission, including a fuel burner located inside an air baffle coaxially with the fuel burner, characterized in that the air baffle is provided with combustion air injection holes in a limited region so that the air for combustion after being injected takes a deviated flow pattern asymmetrical with respect to the axis, while the fuel burner is provided with a fuel injection hole which is inclined toward the the opposite said region of the air baffle.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1 (II) is a diagrammatic front view of said burner construction;

FIG. 2 (II) is a diagrammatic front view of said burner construction;

FIGS. 14 (I) through 14 (III) are graphs showing the relation between the fuel injecting directions and NOx formation;

FIGS. 15 (I), (II) illustrate a concrete example of a combustion apparatus according to the invention;

FIGS. 16 (I), (II) illustrate another concrete example of a combustion apparatus according to the invention.

DETAILED DESCRIPTION OF THE PREFERRED EMBODIMENTS

Figure 1:
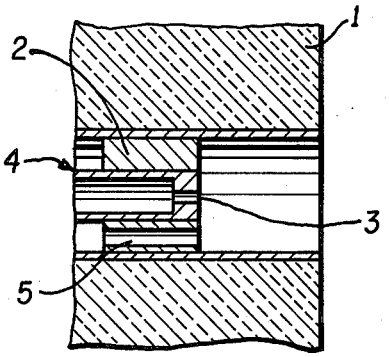
FIG. 1 (I) is a diagrammatic sectional view showing a concrete example of a burner construction used in the present invention.

FIG. 1 (I) is a sectional view showing an example of a burner construction used for combustion according to the invention. The numeral 1 designates a burner tile which forms a burner wall and 2 designates an air baffle fixedly fitted in a bore in said burner tile. Coaxially mounted in a hollow in the air baffle 2 is a burner 4 provided at its front end with a fuel injection tip or hole 3.

The air baffle 2, as shown in FIG. 1 (II), unlike the ordinary one having all its thick section in an opened state, is closed except for holes or injection openings 5 formed in the thick portion along an arc with the center at the axis of the baffle. Therefore, air for combustion is injected into the furnace, not uniformly through all the circumference but locally through holes 5. Thus, in the ordinary conditions where all the circumference of the air baffle is uniformly opened, air for combustion takes a flow pattern symmetrical with respect to the baffle or burner axis (such combustion air flow being referred to as "uniform flow"), whereas, the localization of the air flow opening section of the baffle, as illustrated, ensures that the air injected into the furnace takes a deviated arcuate flow pattern asymmetrical with respect to the baffle or burner tile axis. The amount of deviation of flow depends on the size of the angle (or central angle $\theta$) formed between two lines connecting the opposite sides of the opening section. If the central angle is 360°, the resulting air flow corresponds to the ordinary uniform flow, it being noted that the smaller the angle, the more strongly is the air flow deviated. The amount of deviation, in this case, can be optionally controlled by suitably determining the number and positions of holes formed in the baffle. Another means for imparting deviation to the air flow would be a weir or an obstructing plate installed in a portion of a burner tile opening to locally close the latter, thereby blocking a portion of the air flow through the burner tile or air baffle. Alternatively, it is also possible to install a bent tube upstream of and close to the air inlet port of the burner tile so as to provide a deviated air flow on hydrodynamic principles. In the invention, the combustion air injection opening section defined locally in the burner tile or air baffle is hereinafter also referred to simply as the "opening section" and the angle (or central angle $\theta$) which the opening section forms is referred to as the "straddle angle", which serves as an index to indicate the amount of deviation of injected air flow. In FIG. 1 (II), the holes 5 have been shown as located in the lower half of the air baffle to provide a deviated air flow in the lower region, but, as will be later described, such region where a deviated air flow is provided may be optionally determined. For example, the holes 5 may be provided in the upper region or in the right-hand or left-hand side region of the baffle.

Figure 2:
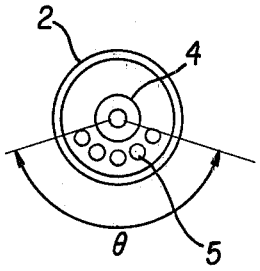
FIG. 2 (I) is a diagrammatic sectional view showing another concrete example of a burner construction.
Figure 2:
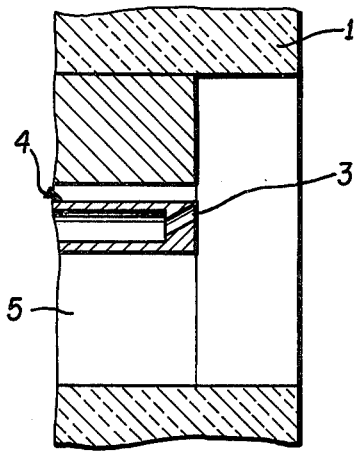

The burner tile or air baffle used in the invention may be rectangular, as shown in FIG. 2, in which case also, as in FIG. 1, it is possible to control the amount of deviation by the straddle angle $\theta$ of said opening section.

In the invention, the deviated injection of air for combustion into a furnace is intended to suppress the quick mixing of fuel and air for combustion, as described above, so as to maintain a slow combustion state while ensuring the burnt gas self-circulation. To this end, the straddle angle is restricted to about 240° or below, as will be later described.

The burner used in the invention may be an ordinary burner (hereinafter referred to as a "straight type burner") wherein the fuel injection hole at the tip is aligned with the burner axis, or it may be another type of burner shown in FIG. 3, wherein the fuel injection hole 3 is inclined at a fixed angle $\alpha$ with respect to the burner axis A (such burner being hereinafter referred to as an "inclined type burner").

Figure 3:
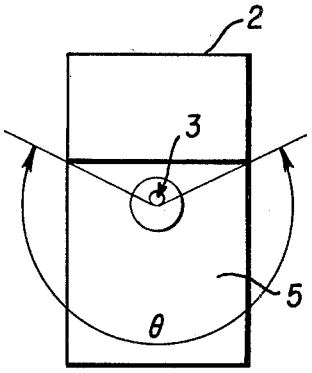
FIG. 3 is a diagrammatic sectional view of a concrete example of an inclined type burner.
Figure 3:
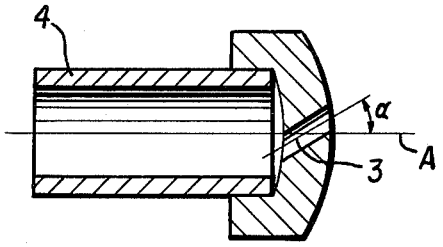
Figure 4:
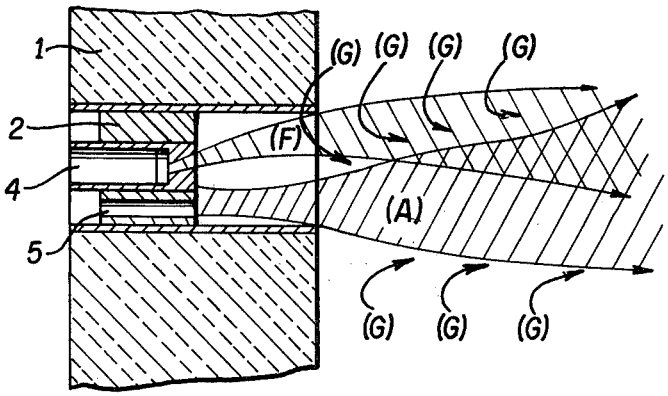
FIG. 4 is a schematic view illustrating a combustion pattern according to the invention.

FIG. 4 schematically illustrates a combustion pattern in a combustion apparatus having the burner construction shown in FIG. 1 (the burner used being an inclined type burner as shown in FIG. 3). In this figure, air A for combustion is injected through an opening section defined in the lower region of an air baffle 2 to spread into the furnace from the lower half of the burner tile 1. Fuel F is injected toward the side with less of the combustion air A, flowing in the half of the burner tile bore to be fed into the furnace. As a result, the mixing of combustion air and fuel is gently effected, so that the combustion proceeds slowly, as compared with the time when a uniform flow of combustion air is provided. Moreover, in the process of such combustion, the burnt gases G, as illustrated, are forced into the combustion air flow A by the momentum of the latter and, besides this, the so called "burnt gas self-circulation" takes place very effectively.

According to the present inventive method, the slow combustion due to gentle air-fuel mixing cooperates with the burnt gas self-circulation to provide a synergistic effect, which ensures a uniform flame temperature distribution with no localized high temperature region in the combustion zone. Thus, under satisfactory combustion conditions, remarkable decrease of NOx can be achieved.

The NOx decreasing effect depends largely on the amount of deviation of flow of combustion air. Since too large a straddle angle $\theta$ of the combustion air injection opening section narrows the spacious region with less of the combustion air adjacent the fuel injection burner, the greater part of the injected fuel soon mixes with the air for combustion, allowing the combustion to proceed quickly and decreasing the amount of burnt gas self-circulation. In order to ensure the satisfactory combustion with a minimum of NOx formation, the necessary amount of deviation to bring about the desirable effects described above must be imparted to the air for combustion. To this end, the straddle angle $\theta$ of the air passage section must be restricted to about 240° or below, as will be described below.

Figure 5:
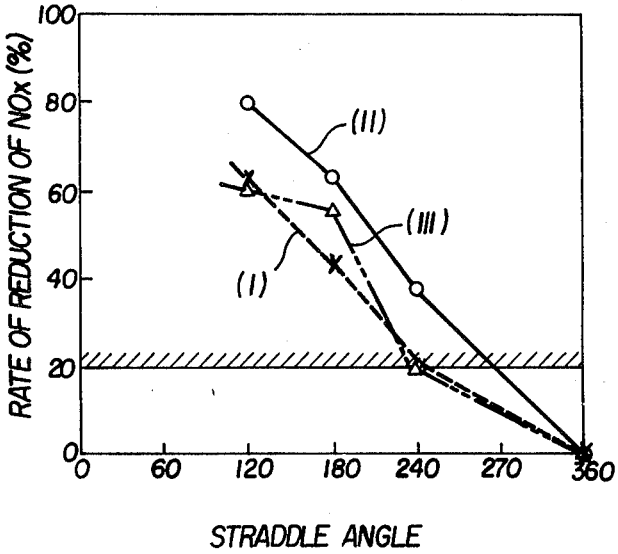
FIG. 5 is a graph showing the relation between the deviation of flow of air for combustion and NOx decrease rate.

FIG. 5 is a graph showing the result of a test for the effects of the amount of deviation of flow of combustion air on NOx decrease, using a combustion test furnace (diameter; 1 m, length; 4 m). (The burner and baffle used were of the type shown in FIG. 1.) The conditions for combustion in this test were as follows:

Fuel; butane gas, rate of combustion; $40\times10^4$ kcal/h, furnace temperature; 1,300°–1350° C., fuel-air ratio; 1.15, preheated combustion air temperature; 320° C., and burner type; straight type or inclined type (each being single-hole burner).

In FIG. 5, a curve (i) refers to the use of the straight burner and curves (ii) and (iii) refer to the use of the inclined type with an angle of inclination 15° and 30° (angle of elevation), respectively. The vertical axis represents the rate of decrease of NOx formation relative to the amount of NOx which forms when the combustion air takes a uniform flow pattern (the amount of NOx in the case of a uniform flow pattern being 108 ppm for the straight type burner, 80 ppm for the 15° inclined type, and 56 ppm for the 30° inclined type). As is apparent from the graph, the rate of decrease of NOx increases as the straddle angle $\theta$ of the combustion air injection opening section is decreased to increase the amount of deviation, irrespective of the burner type, it being seen that the amount of NOx for the straddle angle of about 240° or below decreases about 20% or above as compared with the amount of NOx attendant on a uniform air flow (straddle angle $\theta=360°$). Above all, the effect of using the inclined type burner is remarkable, the rate of decrease for a straddle angle of 120° being as high as 80%. The inclined type burner has the function of allowing fuel-air mixing in early stages of combustion to proceed slowly, lowering the maximum flame temperature and allowing the combustion to proceed at a constant temperature, thereby decreasing the amount of formation of so-called "thermal NOx" and "fuel NOx". This effect of the inclined type burner cooperates with the effect brought about by the controlled deviation of flow of air for combustion to contribute to further decreasing the amount of NOx formation. The inclination angle $\alpha$ of the inclined type burner for effectively developing the aforementioned function may be selected within the range of about 5°–45°, the most preferable value being about 30° C.

The inclined type burner is one technique for decreasing NOx, having the function of suppressing fuel-air mixing, as described above. Generally, it is said that the effect of decreasing NOx attained by using, in combination, two or more types of NOx decreasing techniques falls far short of the sum of their individual effects. In contrast, according to the invention, the combined use of different techniques for decreasing NOx, namely, the inclined type burner and the control of deviation of combustion air flow provides a synergistic effect, achieving the surprising decrease of NOx. Such synergistic effect can also be attained by the combined use of two or more techniques for decreasing NOx to be later described. Thus, the present invention is characterized, in one aspect, in that, unlike the conventional, generally accepted concept, the combined use of different types of NOx decreasing techniques produces a further improved NOx decreasing effect.

The NOx decreasing effect according to the invention can be further improved by using, singly or in combination, such combustion control methods as burner type, air flow rate, fuel-air flow rate ratio, direction of fuel injection, and burner tip position, as will be described below.

Figure 6:
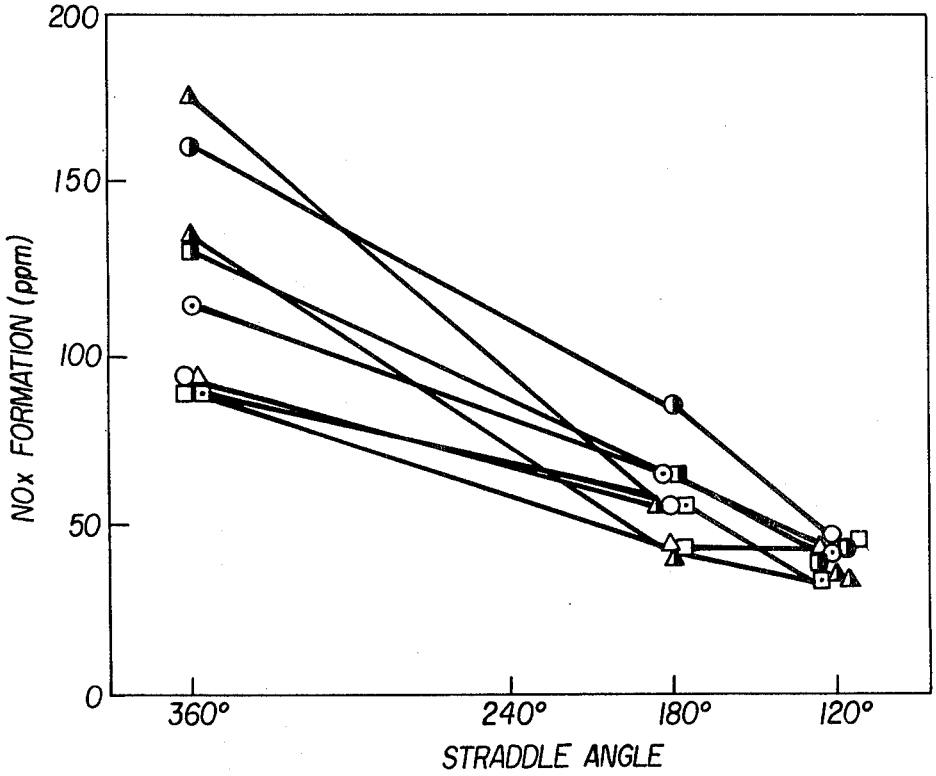
FIG. 6 is a graph showing the relation between the deviation of air flow combustion and NOx formation.

FIG. 6 is a graph showing, in comparison, the amounts of NOx (as 11% $O_2$, hereinafter the same) emitted when various burners were used, with the straddle angle $\theta$ of the combustion air injection opening section being changed variously, in a combustion test machine using heavy oil (class C). The marks in the graph are used to distinguish among the burner types, as shown in Table 1.

TABLE 1

| | | | Conditions for Combustion | | |
|---|---|---|---|---|---|
| Fuel flow rate* | | | a | b | c |
| Burner type | Straight | | ○ | ⊙ | ⊖ |
| | Inclined | 10° | △ | ◬ | ◭ |
| | | 20° | □ | ⊡ | ⊟ |

*The fuel flow rate differs with the injection hole diameter of the burner used, the flow rates a, b and c being such that b is twice a and c is thrice a.

It can be seen in the graph that as the straddle angle $\theta$ is decreased to intensify the deviation, the NOx decreasing effect is elevated, though there is some difference in degree according to the burner type, and that the straddle angle $\theta$ of 240° or below is particularly effective to decrease the amount of NOx emission.

Figure 7:
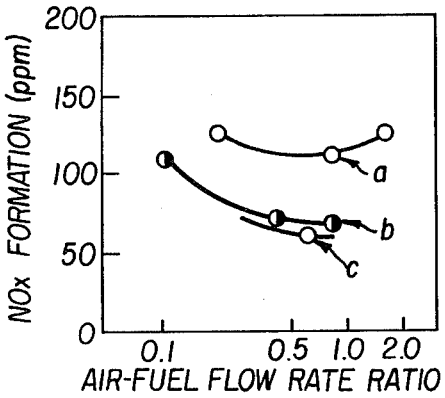
FIGS. 7, 8 and 9 are graphs showing the relation between air-fuel flow rate ratio and NOx formation.
Figure 8:
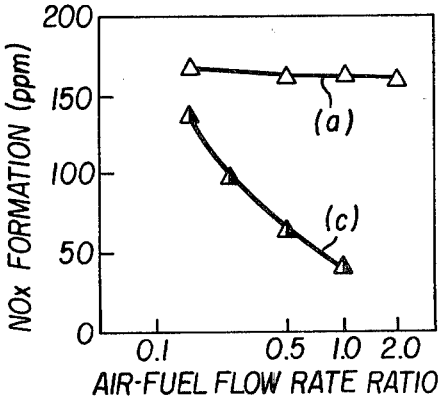

FIG. 7 is a graph showing the relation between the fuel-air flow rate ratio (fuel flow rate/air flow rate ratio) and the amount of NOx emitted in a combustion test using butane gas as fuel and the amount of deviation of flow of combustion air as a parameter. In the graph, a curve (a) refers to the case of the air flow being uniform (the straddle angle=360°), a curve (b) refers to the case of the straddle angle being 180°, and a curve (c) refers to the case of the straddle angle being 120°. In addition, in each case, the air injecting opening section is positioned in the lower portion of the air baffle, and the angle of inclination of the fuel injection hole in the burner used is expressed in terms of an angle of elevation. FIG. 8 is a graph showing the result of measurement of the amount of NOx emitted in a combustion test conducted under substantially the same conditions as in FIG. 7 except for using coke oven gas (COG) as fuel. However, the angle $\alpha$ of inclination of the fuel injection hole was 15°.

As demonstrated in FIGS. 7 and 8, although the amount of NOx varies with the kind of fuel and the burner type, the larger the amount of deviation of combustion air flow, the smaller the amount of NOx formation, it being noted that in the case of gaseous fuels, the decrease of the amount of NOx is remarkable when the fuel-air flow rate ratio is about 0.3 or above, especially about 0.5–2. In addition, in the case of liquid fuels, the flow rate ratio has little bearing on the formation of NOx.

Figure 9:
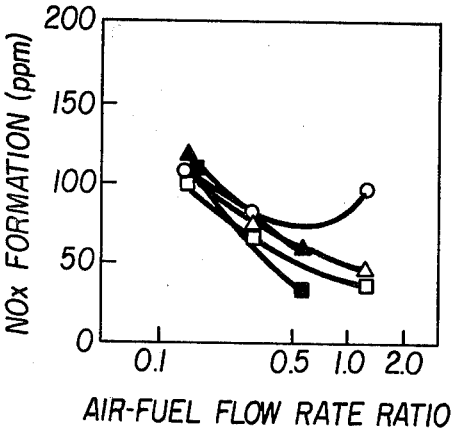

FIG. 9 is a graph showing the fuel-air flow rate ratio and the amount of NOx formation emitted with various burner types, using butane gas as fuel, the straddle angle $\theta$ of the air flow opening section being 240°. In the graph, the "circle" marks refer to a straight type burner, "triangle" marks refer to an inclined type burner with an angle of inclination $\alpha$ of 15° (or 10°), and "square" marks refer to an inclined type burner with an angle of inclination $\alpha$ of 30° (or 20°). (The air flow rate for the shaded marks is about twice that for the unshaded marks.) It will be seen that, as described above, by intensifying the deviation of air flow and increasing the fuel-air flow rate ratio, excellent results can be obtained within a definite range of fuel-air flow rate ratio for each kind of fuel.

As described above, the NOx decreasing effect is improved by imparting a definite amount of deviation to the combustion air and by using an inclined type burner rather than a straight type burner, the optimum decrease of NOx formation being attained by using an inclined type burner whose angle of inclination $\alpha$ is about 30°. If, however, such inclined type burner with an angle of inclination $\alpha$ of about 30° is directly used in an actual apparatus, the very large angle of deviation of the injected fuel flow may sometimes result in the fuel sticking to the furnace wall or the burner tile bore wall, thus imposing restrictions on the practical angle of inclination; actually, angles of about 10°–20° are employed. Further, whether the fuel injection flow is deviated or not greatly influences the fuel-air mixing state, causing the latter to change completely. Under these circumstances, the control of the fuel-air flow rate ratio as described above will be employed as a very effective methods for satisfactorily decreasing the amount of NOx formation.

Figure 10:
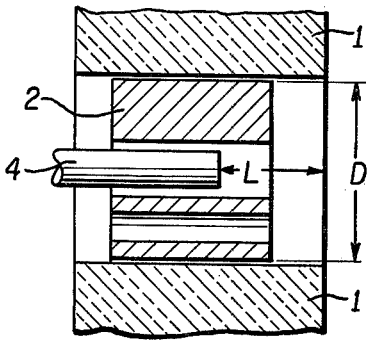
FIG. 10 is a view illustrating the installation of a burner in a burner section.

In the present invention, it is possible to decrease the amount of NOx formation in a stabilized manner by additionally adjusting the fuel injection burner tip position. The term "burner tip position", as shown in FIG. 10, refers to the distance L from the inner furnace end surface(f) of the burner tile 1 to the tip of the burner 4. From the standpoint of the quick and uniform mixing of injected fuel flow and combustion air flow, the early completion of combustion, and the prevention of burner tip heat-damage, the burner tip has normally been positioned rearwarly of the end surface (f) of the burner tile, at a position of about 1–1.5 expressed in terms of L/D.

Figure 11A:
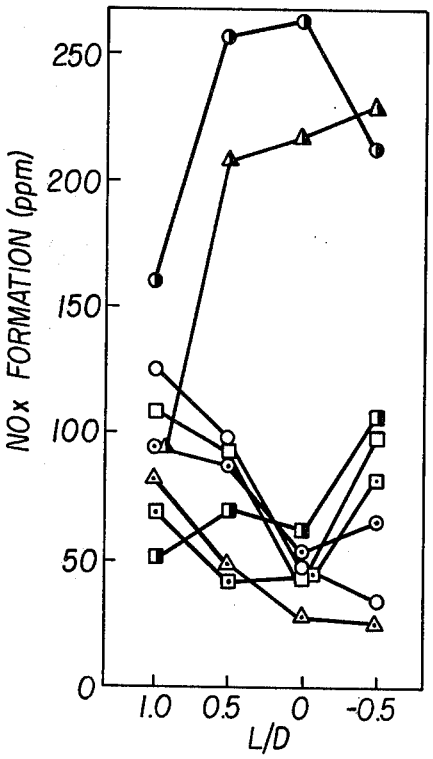
FIGS. 11 (A), (B) and 12 (A), (B) are graphs showing the relation between the burner tip position and NOx formation.
Figure 11B:
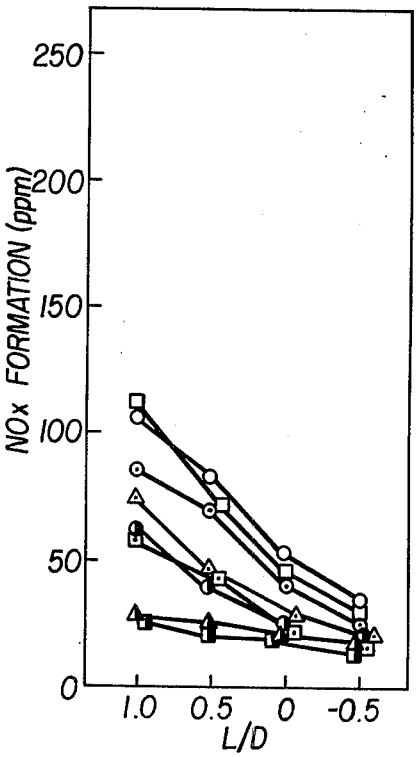

FIG. 11(A) and 11(B) show the relation between the burner tip position and the amount of NOx formation recorded when the straddle angle $\theta$ was 180° and butane gas was used as fuel, the numerical values on the horizontal axis indicate the burner tip position. ($L/D=0$ means that the burner tip is flush with burner tile inner end surface (f) and $L/D<0$ means that the tip projects into the furnace.) In FIG. 11(A), the combustion air flow is uniform (the straddle angle $\theta$ of the opening section is 360°) and in FIG. 11(B), it is deviated (the straddle angle $\theta$ is 180°). The marks in the graphs are used to distinguish between the burner types (straight type and inclined type) and between the fuel flow rates due to differences in the fuel injection hole diameter, as shown in Table 2.

TABLE 2

| Fuel flow rate* | | | a' | b' | c' |
|---|---|---|---|---|---|
| Burner type | Straight | | ○ | ⊙ | ⊜ |
| | Inclined | 15° | — | ▲ | ▲ |
| | | 30° | □ | ⊡ | ⊟ |

*The flow rates a', b' and c' are such that b' is twice a' and c' is 8 times a'.

As shown, when the combustion air flow is uniform (FIG. 11(A)), bringing the burner tip closer to the furnace, in some cases, tends to decrease the amount of NOx, through not very much, but in other cases, it tends to increase the amount of NOx, thus making it impossible to expect a definite result. In contrast, the NOx decreasing effect attained by imparting deviation to the combustion air flow according to the invention is clear and definite, irrespective of the burner type, and particularly when L/D is nearly 0 (the burner tip being flush with the inner end surface (f) of the furnace), there is observed an excellent effect which decreases the amount of NOx to about half or below, in contrast to the conventional method.

Figure 12A:
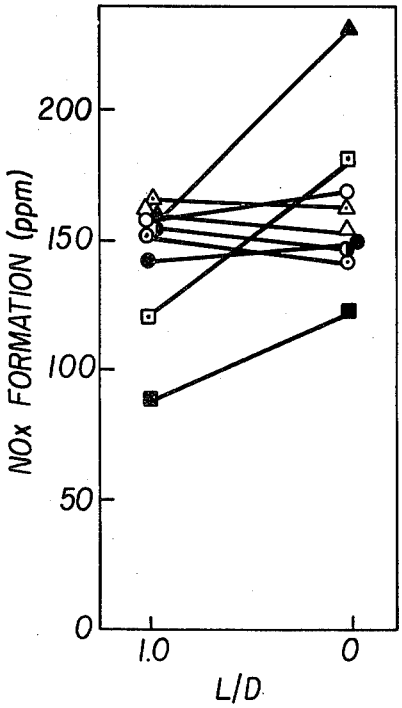
Figure 12B:
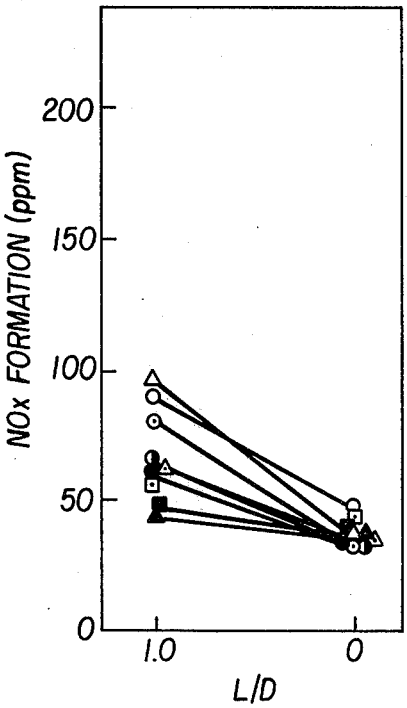

FIGS. 12(A) and 12(B) show the relation between the burner position and the amount of NOx formation recorded in the same way as in the combustion test in FIG. 11, but using COG as fuel. The marks in the graphs are used to distinguish between the burner types and between the fuel injection hole diameters, as shown in Table 3.

TABLE 3

| Fuel flow rate* | | | a'' | b'' | c'' | d'' |
|---|---|---|---|---|---|---|
| Burner type | Straight | | | | | |
| | Inclined | 15° | Δ | | — | |
| | | 30° | — | | — | |

*The flow rates a'', b'', c'' and d'' are such that b'' is twice a'', c'' is thrice a'' and d'' is 4 times a''.

As in the case of FIG. 11(A) and 11(B), there is observed a remarkable NOx decreasing effect based on the burner position control when the combustion air flow is deviated according to the invention.

In addition, in the case of FIGS. 11(A) and 11(B), FIGS. 12(A) and 12(B) the combustion is outside the optimum range of fuel flow rate/combustion air flow rate ratio (which varies with the kind of fuel, such as butane gas and COG, and which is determined with due consideration given to the temperature distribution in the furnace). As a result, even when an inclined burner is used or means for bringing such burner closer to the inner end surface of the furnace is used (particularly in the case of FIG. 11(A) and FIG. 12(A)), the amount of NOx formation is relatively high. In other words, the methods for deviating the air flow, when used alone, is capable of suppressing the formation of NOx more effectively than the inclined type burner or the methods for bringing such burner closer to the inner end of the furnace, irrespective of the flow rate ratio. (It goes without saying that if the flow rate ratio is set within the optimum range, the resulting effect is more remarkable.) The deviating method is also advantageous from the standpoint of combustion conditions in that it enlarges the optimum range.

The reason why shifting the burner tip toward the inner side of the furnace is effective to decrease the amount of NOx formation is that it prevents fuel-air mixing from proceeding early within the burner tile of small volume and instead allows mixing to proceed gently in the spacious region and that the resulting jet of combustion air being injected into the furnace has a sufficient momentum to carry the burnt gases to enable the burnt gas self-circulation toward the combustion zone to take place effectively. The position at which the burner tip must be set in order to sufficiently decrease the amount of NOx formation varies with the burner type, and it is necessary that the distance L between the inner end surface (f) of the furnace and the burner tip be not more than about 0.8 times the bore diameter D for the straight type burner and not more than about 1.3 times the bore diameter D for the inclined type burner (each case including positions at which the burner tip projects into the furnace interior), it being particularly preferable that it be flush with the inner end surface of the furnace (L/D=0). In addition, if the burner tip is set in the furnace interior, it is desirable that the angle of the diverging bore in the burner tile (the angle the inclined inner wall surface of the burner tile forms) be about 45° or below, in order to attain satisfactory combustion and effective decrease of NOx formation.

Figure 13:
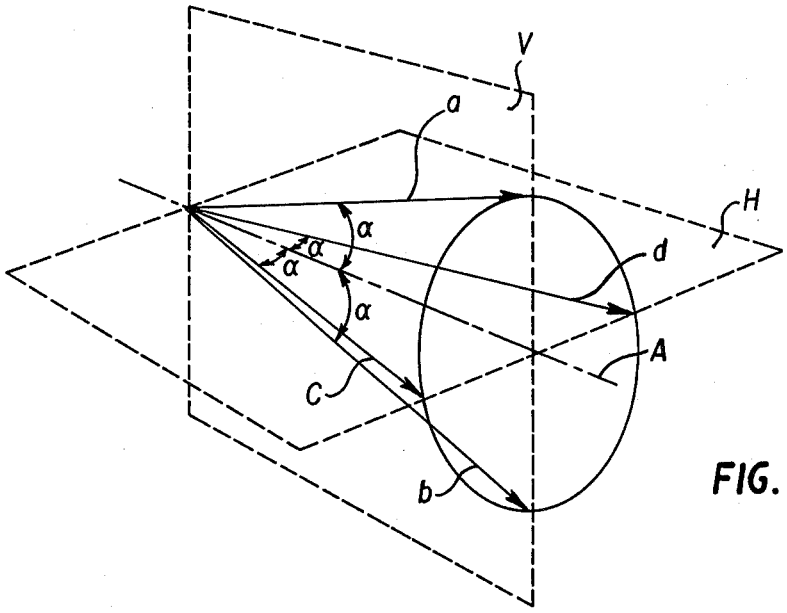
FIG. 13 is a view illustrating the fuel injecting directions of a burner.

The NOx decreasing effect in the present invention can be further intensified by adjusting the direction of injection of fuel being fed from the burner. The term "direction of injection of fuel" refers, as shown in FIG. 13 when using an inclined type burner with a definite angle of inclination $\alpha$, to a direction (a) in which the fuel injection hole forms an angle of elevation $\alpha$ with a horizontal plane H including the burner tile or air baffle axis A, a direction (b) in which it forms a dip $\alpha$ with said horizontal plane, or a direction (c) or (d) delfected to the left or right on said horizontal plane H. In short it refers to the direction in which the fuel injection hole is inclined with respect to the axis A.

FIGS. 14(I)–(III) are graphs showing the relation between the direction of fuel injection and the amount of NOx formation when the combustion air flow was deviated and the direction of fuel injection using an inclined type burner was changed variously. (Butane gas was used as fuel.) The combustion conditions in the graphs are as shown in Table 4.

TABLE 4

| FIG. No. | Air baffle: Position of opening section | Air baffle: Straddle angle ($\theta$°) | Burner, angle of inclination ($\alpha$°) |
|---|---|---|---|
| I | Upper | 180 | 15 |
| II | Upper | 120 | 15 |
| III | Lower | 120 | 15 |

In each of these figures, the symbol at upper left indicates the position of the combustion air outlet section in the air baffle, the shaded portion being the opened area, the central angle $\theta$ being the straddle angle of the opened area. The horizontal axis of each graph represents the direction of fuel injection expressed in terms of angle (°). For example, if the angle is 0° (or 360°), this means the direction (b), in FIG. 13, in which the injection hole forms an angle of elevation $\alpha$ with the vertical plane V including the axis A; the angle of 90° means the direction (c) in the horizontal plane H; the angle of 180° means the direction (a) which forms a dip $\alpha$ in the vertical plane V; and the angle of 270° means the direction (d) in the horizontal plane H. In the graph, the unshaded marks refer to the case where the burner tip position is set so that L/D=0, and the shaded marks refer to the case where it is set so that L/D=1.0 (see FIG. 10).

As can be understood from these figures, by injecting fuel to a region other than the one to which deviated air flow for combustion is introduced, especially to the side opposite to said deviated air flow (for example, if the lower portion of the air baffle is opened and deviated air for combustion is fed therethrough, the fuel injection hole in the burner is pointed in the direction (a) in FIG. 13), a substantial decrease in NOx can be achieved.

As for the directions of injection of air for combustion and fuel, they may be adjusted relative to each other so that the directions of air and fuel may not coincide with each other. Thus, so long as the direction of fuel injection is determined with consideration given to the direction of deviated flow of air for combustion, the air may be injected through the upper or lower portion or right-hand or left-hand side portion of the air baffle or in any desired direction. If, however, a steel material, which is the work to be heated in the furnace, is subjected to the air flow, it is cooled thereby, which is disadvantageous from the standpoint of efficiency of heating. To avoid this, it is desirable to determine the deviated direction of air flow depending upon the relative positional relation between the burner and the steel material, in such a manner that air flow does not impinge directly against the steel material.

Other examples of methods for effectively decreasing the amount of NOx emission will now be described.

FIG. 15(I) is a sectional view of an embodiment of the combustion apparatus of the invention, and FIG. 15(II) illustrates the arrangement of air injection openings in combustion air feed passages on the inner side of a furnace. The numeral 4 designates a fuel injection burner; 7 designates a first-stage combustion air feed passage surrounding the burner; 1 designates a burner tile; 8 designates second-stage combustion air feed passages disposed outside the burner tile; and 6 designates second-stage combustion air flow control valves (or dampers). The character 9 designates the axis of the burner 4 or burner tile 1. As illustrated, the first-stage air feed passage 7 opens around the entire outer periphery of the burner 4, while the opening section of the second-stage air feed passages 8 is defined by a plurality of flow holes 8 disposed in the range of a straddle angle $\theta$, namely, a central angle $\theta$ formed between lines connecting the opposite sides of the opening section to the burner tile axis. This straddle angle $\theta$ is set at 240° or below, as will be later described. In FIG. 15(II), 5 flow holes are shown, but the number of holes may be suitably increased or decreased in the range of the straddle angle $\theta$. It is also possible to employ a single arcuate flow hole extending along an arc subtending the angle $\theta$.

In the conventional two-stage combustion apparatus, since the first-stage and second-stage air feed passages have their opening sections completely surrounding the burner, the combustion air flow injected into the furnace is symmetrical with respect to the axis of the burner tile or is uniform. On the other hand, in the apparatus of the invention, since the opening section of the second-stage air feed passages is limited to a definite range indicated by the straddle angle $\theta$, the total flow of combustion air injected from the first-stage and second-stage air feed passages assumes a deviated pattern asymmetrical with respect to the burner axis. The deviation of air flow becomes intensified, of course, as the straddle angle $\theta$ is decreased. The intensity of the deviation of air flow can be controlled by adjusting not only the straddle angle $\theta$ but also the diameter, number and positions of flow holes.

In the invention, since the object of injecting combustion air into the furnace in a deviated flow pattern is to avoid the early mixing of fuel and combustion air, so long as this object is achieved the position of the opening section of air feed passages is not limited to the upper portion of the burner tile as shown in FIGS. 15(I) and 15(II) and instead it may be in the lower portion or the right-hand or left-hand side of the burner. In the arrangement shown in FIGS. 16(I) and 16(II) the second-stage air feed passages 8 are disposed to completely surround the burner tile axis, each air feed passage being provided with an air flow control valve (or damper) 6 for defining an opening section having a desired straddle angle $\theta$ at a desired position circumferentially around the burner tile axis by opening and closing of the flow passages by the manipulation of the valves. The first stage air feed passage includes an air baffle 2.

Figure 17I:
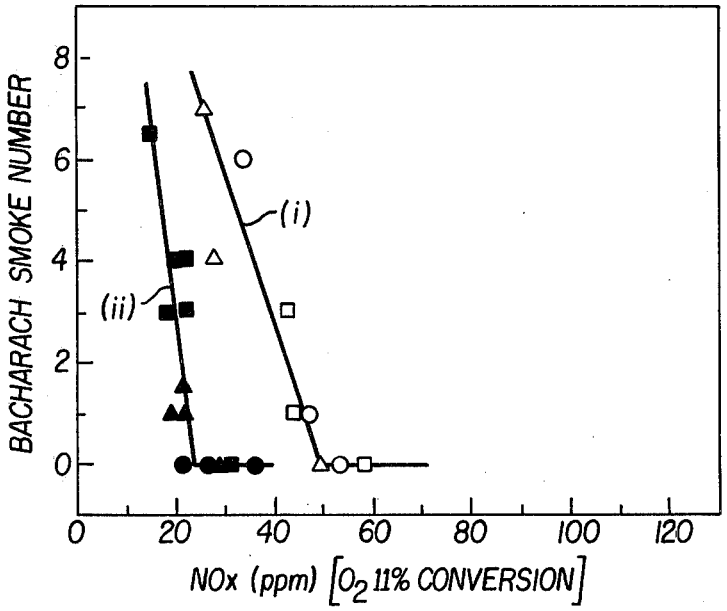
FIGS. 17 (I), (II) are graphs showing the relation between NOx formation and smoke evolution.
Figure 17:
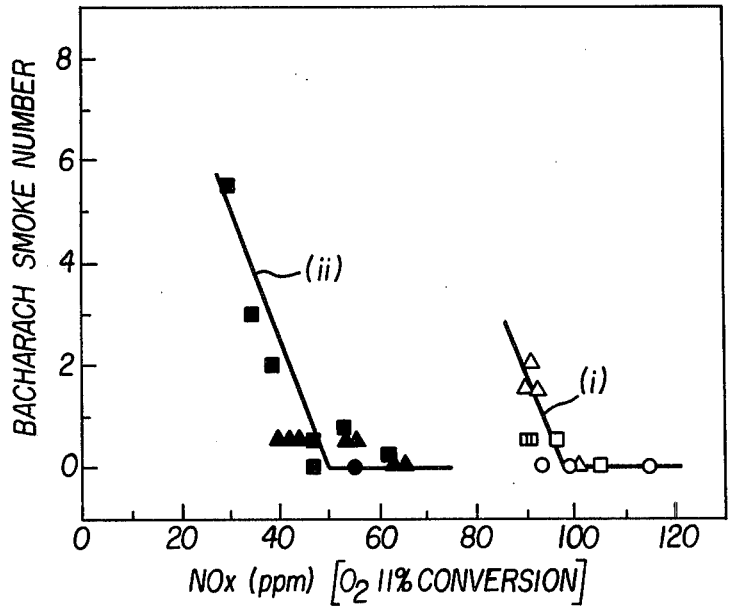

According to the method of the present invention, while achieving the minimization of NOx emission, as described above, it is possible to effectively prevent the emission of smoke, thus ensuring a satisfactory combustion with a minimum of heat loss. FIGS. 17(I) and (II) are graphs showing the relation between the amounts of NOx and smoke emission, obtained in combustion tests using different types of burners and using butane gas in (I) and heavy oil (class C) in (II) as fuel. In the graphs, the circle marks refer to the use of a straight type burner and the triangle and square marks refer to the use of inclined type burners with an angle of inclination $\alpha$ of 15° and 30°, respectively. (The unshaded marks refer to the case where the combustion air flow is uniform, and the shaded marks refer to the case where it is given an amount of deviation corresponding to a straddle angle $\alpha$ of 180°.) The direction of injection of fuel by the inclined type burners was the direction (a) shown in FIG. 13. The air baffle opening section for imparting deviation to flow of air for combustion was in the lower portion of the air baffle in each case. As shown in FIG. 17(I), in the conventional case where the flow of air for combustion is not deviated (curve (i)), the amount of NOx emission cannot be decreased to less than about 50 ppm without the emission of smoke, whereas according to the method of the invention no smoke emits even if the amount of NOx emission is decreased to about 20 ppm. FIG. 17(II) refers to the case where heavy oil (class C) is used as fuel. The combustion conditions and the meanings of the various marks used therein are the same as in FIG. 17(I), except that the angle of inclination $\alpha$ of the inclined type burner is 10° (the triangle marks) and 20° (the square marks). The smoke emission preventing limit attained by the conventional method is 100 ppm NOx and any further decrease of NOx emission is attended with the emission of smoke (curve (i)), whereas according to the invention, NOx emission can be decreased to about 50 ppm without the emission of smoke while ensuring a satisfactory combustion.

Generally, in order to prevent the emission of smoke, it is necessary to feed a large amount of air (oxygen) required for combustion, but the increased supply of air also increases the amount of exhaust gases. As a result, the amount of heat taken away by the exhaust gases increases, which means increased heat loss and increased fuel cost. Accordingly, combustion which requires a decreased amount of air is desired. According to the invention, since the emission of smoke can be prevented effectively as compared with the conventional method, as described above, a stabilized state of combustion requiring a relatively small amount of air is achieved, which is very advantageous from the standpoint of heat economy, contributing to energy saving.

As has been described so far, according to the present invention, a definite amount of deviation imparted to combustion air flow effectively decreases the amount of NOx emission and, when combined with other techniques for decreasing the amount of NOx emission, it further decreases the amount of NOx emission. Further, a uniform temperature distribution in the furnace is achieved together with a uniform flame radiation distribution, a feature which is advantageous particularly to soaking pits. Additionally, a stabilized state of the combustion is obtained, providing for very economical combustion, saving fuel cost, etc.

Obviously, numerous modifications and variations of the present invention are possible in light of the above teachings. It is therefore to be understood that within the scope of the appended claims, the invention may be practiced otherwise than as specifically described herein.

What is claimed is:

1. A method of combustion with a minimum of emission of oxides of nitrogen from furnaces or boilers having a burner tile forming a burner wall including a bore formed therein, a burner disposed within said bore, a burner tip integral with said burner, an air baffle including an axial bore having a longitudinal axis and disposed within said burner tile, said baffle surrounding said burner and having at least one air injection opening formed therein and communicating with said axial bore for defining an arcuate axial air flow path about said burner having a longitudinal axis through said tile, a material to be heated, and means for supplying fluid fuels to said furnaces or boilers for combustion with air, wherein said method comprises:

introducing said air through said burner tile via said at least one air injection opening;

axially channeling said air through said at least one air injection opening such that said air is injected into said furnaces or boilers through a flow path included within an arc of less than 240° about said axis of said air baffle;

forming an arcuate flow of air included within said arc flowing asymmetrically about said axis of said air baffle;

directing said arcuate flow of air in an axial direction with respect to said axis of said air baffle; and injecting said fluid fuels through said burner tip at an angle from 5° to 45° with respect to said axis of said burner and away from said arcuate flow of air.

2. A method of combustion as set forth in claim 1 which further comprises maintaining the proportion of the flow rate of said fluid fuels to the flow rate of said air to a ratio of greater than 0.3.

3. A method of combustion as set forth in claim 1, which further comprises maintaining the proportion of the distance of said burner tip from the inner surface of said burner wall to the diameter of said bore formed in said burner tile at said inner surface to a ratio of less than 1.3.

4. A method of combustion as set forth in claim 1, which further comprises directing said air so as to avoid direct impingement with said material to be heated.

5. A method of combustion as set forth in claim 1, which further comprises injecting said fluid fuels away from the geometric center of said arcuate flow of air.

6. A two stage combustion apparatus for use with industrial furnaces or boilers comprising:

a burner tile operatively associated with said furnaces or boiler, having a first opening formed therethrough;

a burner having an axis disposed within said first opening in said burner tile;

an air baffle having a first stage arcuate combustion air feed passage means disposed within said first opening of said burner tile and partially surrounding said burner; and at least one air injection opening formed through the inner surface of said burner tile and forming at least one second stage air feed passage and means for communicating said at least one air injection opening with said first stage combustion air feed passage, said first stage air feed passage and said second stage air feed passage each forming an arcuate air injection flow path into said furnaces or boilers included within an arc of less than 240° with respect to the axis of said burner.

7. An apparatus for combustion with a minimum of emission of oxides of nitrogen comprising:

a furnace or boiler;

a burner tile forming an inner wall of said furnace or boiler;

a fuel burner operatively associated with said furnace or boiler disposed within said burner tile and recessed from the inner surface of said inner wall;

air baffle means coaxially surrounding said fuel burner and disposed within said burner tile and recessed from the inner surface of said inner wall and having at least one air injection hole formed therein for directing air for combustion through a flow path asymmetrical with respect to the axis of said fuel burner; and a fuel injection hole formed within said fuel burner and inclined away from said air injection holes.

* * * * *